United States Patent [19]

Hanger et al.

[11] 4,433,950

[45] Feb. 28, 1984

[54] SELF-FEEDING APPARATUS AND METHOD

[75] Inventors: James E. Hanger; Charles T. Walker, both of Panama City, Fla.

[73] Assignee: Charles Tillman Walker, Lynn Haven, Fla.

[21] Appl. No.: 278,858

[22] Filed: Jun. 29, 1981

[51] Int. Cl.[3] ..... A47G 21/08

[52] U.S. Cl. ..... 414/9; 222/357; 414/786

[58] Field of Search ..... 414/9, 786, 915; 222/356, 357, 358, 642, 643, 650

[56] References Cited

U.S. PATENT DOCUMENTS

| | | | |
|---|---|---|---|
| 1,333,208 | 3/1920 | Maguire | 414/9 |
| 1,333,209 | 3/1920 | Maguire | 414/9 |
| 2,179,446 | 11/1939 | Dahlstrom | 222/357 X |
| 2,608,073 | 3/1950 | Hill | 414/9 |
| 2,686,408 | 8/1954 | Walker | 414/9 |
| 3,317,061 | 8/1964 | Causey | 414/9 |
| 3,734,306 | 5/1973 | Morewood | 414/9 |
| 3,885,681 | 5/1975 | Mancino | 414/9 |
| 4,277,213 | 7/1981 | Morewood | 414/9 |

*Primary Examiner*—Leslie J. Paperner
*Attorney, Agent, or Firm*—Ralph Bailey

[57] ABSTRACT

A self-feeding apparatus and method is illustrated wherein a pivoted arm carries a spoon between a raised position for eating and a lower position for filling from a plate. The spoon is permitted to fall about its pivotal connection by gravity and then the arm carrying the spoon is lowered so as to push the spoon forwardly or radially of the plate which is preferably turned simultaneously in order to fill the spoon with food preparatory to the user or operator taking another bite.

15 Claims, 4 Drawing Figures

SELF-FEEDING APPARATUS AND METHOD

BACKGROUND OF THE INVENTION

Prior art self-feeding devices for use by handicapped persons have been limited to very simple movements which either result in the accommodation of a limited variety of food to be consumed by the user or else such devices are ineffective in utilizing the food available in the plate or bowl. Little user selectivity is permitted in the foods to be eaten as may be dictated by the desires of the user. Prior art devices have been provided which utilize a rigid, circumferential path about the eating vessel so that the varieties of foods available are limited.

It is a special object of the present invention to provide a mechanism which advances a spoon across or radially with respect to the plate. While such forward movement of the spoon is occurring, the plate itself turns incrementally toward the spoon so as to facilitate filling of the spoon preparatory to positioning the spoon in raised position for eating.

U.S. Pat. No. 2,686,408 discloses an automatic device for handicapped persons which includes a rotatable plate and a spoon which elevates from a filling position to a feeding position by means of movement over a wire track in a fixed path. Upon actuation, the plate rotates a predetermined increment and the spoon begins to rotate simultaneously therewith to pick up a desired amount of food as the spoon travels along the wire track to the feeding position. U.S. Pat. No. 3,734,306 discloses a spoon elevating motor and cam controlled switch for raising and lowering the spoon. The following U.S. Pat. Nos. further illustrate the state of the art; 1,333,208; 1,333,209, 2,686,408; 3,317,061 and 3,885,681.

SUMMARY OF THE INVENTION

It has been found that a versatile self-feeding apparatus may be provided by utilizing a spoon carried by a pivoted arm or handle which may be permitted to fall by gravity about its pivot point, with the pivot point itself then being lowered to advance the spoon across the plate accompanied by incremental turning of the plate toward the spoon resulting in the filling of the spoon preparatory to being returned to raised or eating position. A number of switches are sequentially operated to provide automatic operation of the device. Separate motors are contemplated for operating the spoon and for operating the table which carries the plate so that selective operation is permitted wherein the user can override the automatic sequence of events to fill the spoon with food of any desired variety of his own choosing from the plate.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a self-feeding apparatus having a rotating table A for carrying a plate holding food. A spoon B is carried by an arm C. Power operated latching means D are provided for maintaining the spoon in raised position in respect to the arm for eating. Switch means E operate to release the latching means permitting the spoon to be lowered, about its pivoted arm C, into the plate. Linkage means F lowers the arm causing the spoon to move forwardly on the plate. Means G rotates the table to cause the spoon to pick up food, whereupon the latching means is secured, and the linkage means F raises the spoon from the plate to eating position.

Figure 1:
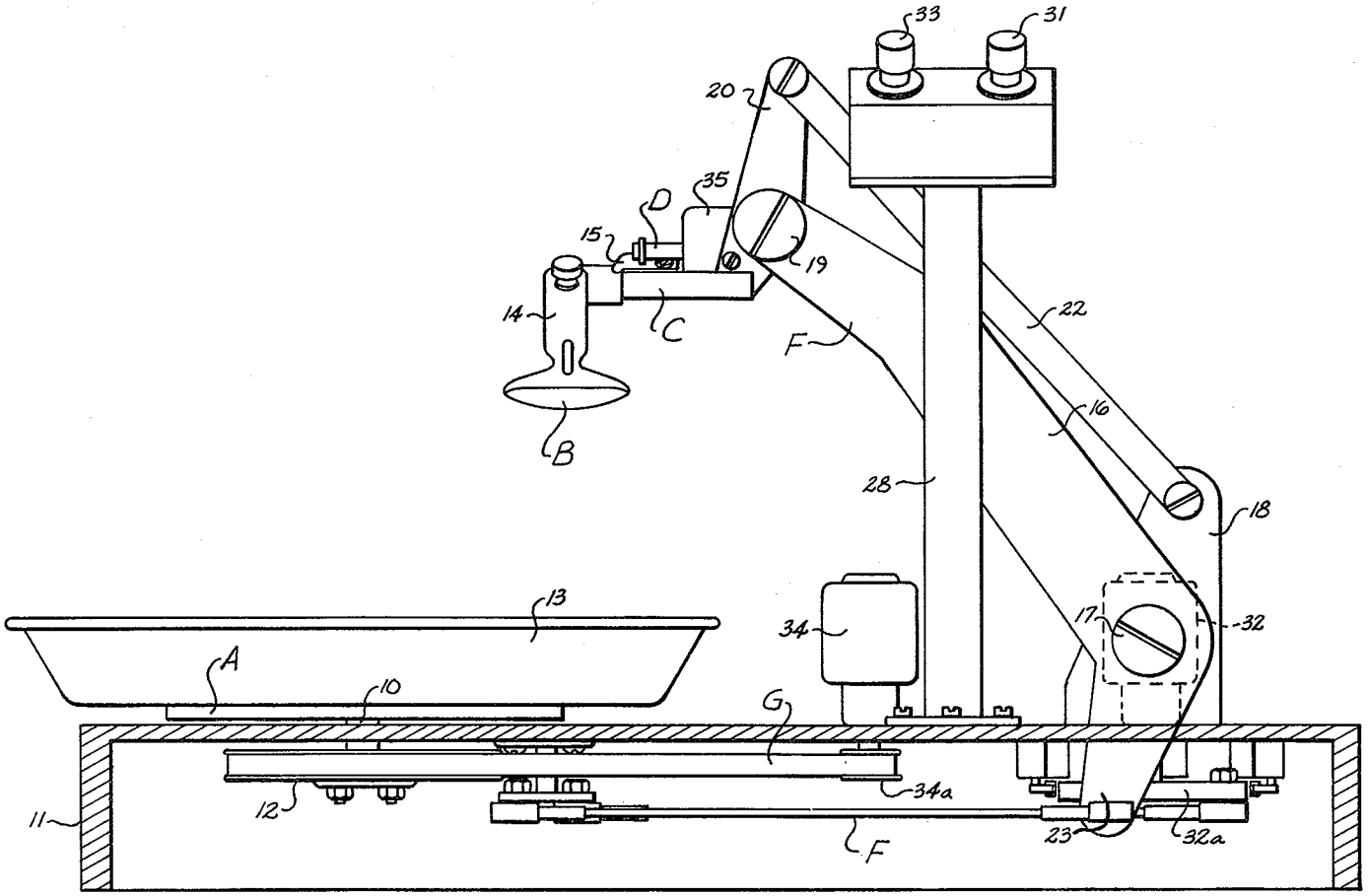
FIG. 1 is a schematic side elevation, partially in section, illustrating a self-feeding apparatus constructed in accordance with the invention.

Referring more particularly to FIG. 1, the rotating table A is illustrated as being carried on a shaft 10 which projects upwardly through a support 11, which is illustrated in section. The shaft carries a sheave 12 on a free end thereof extending beneath the support 11. A plate 13 is illustrated as being carried upon the table A. While it is preferable that the plate be a separate member which may be centrally positioned so that such may be removed from the table for washing, it is possible that the table and plate can be combined and suitably secured for rotation upon the table A. The spoon B is illustrated as having a pivoted arm or handle 14 which is, in turn, carried upon an arm C. A power operated latching means D includes a latch member 15 which is suitably released by a solenoid 35, which will be described in greater detail below.

Figure 3:
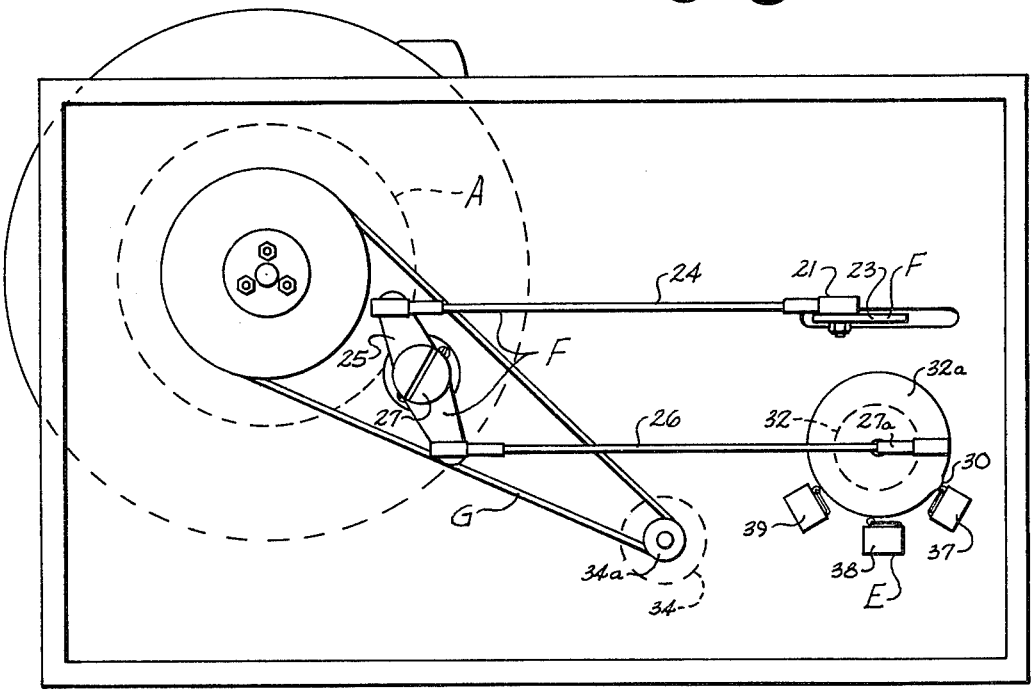
FIG. 3 is a bottom plan view further illustrating the self-feeding apparatus.
Figure 4:
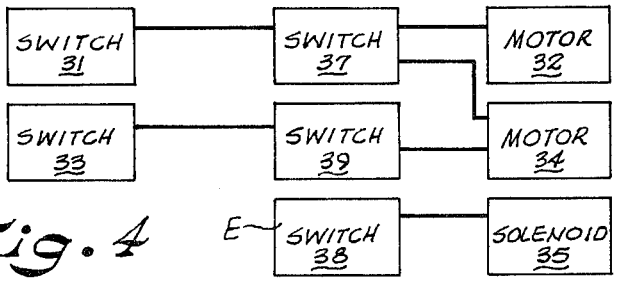
FIG. 4 is a block diagram illustrating the switch and motor arrangements utilized in controlling the elements of the invention exemplified in FIGS. 1–3.

A switch means E (FIGS. 3 and 4) is operated to release the latch means permitting the spoon to be lowered into the plate. Linkage means F are provided for lowering the arm C causing the spoon to move forwardly on the plate. The linkage means F includes a link 16 which is pivoted intermediate its ends as at 17 upon a bracket 18 carried in fixed relation to the table. The link has pivotal connection on one end as at 19 with a spoon carrying bracket 20 on one end and is pivotally connected on the other end thereof to the linkage F as by the connection 21 (FIG. 3). Link 22 is aligned with the member 16 and has pivotal connection on each end thereof respectively with the brackets 20 and 18.

Figure 2:
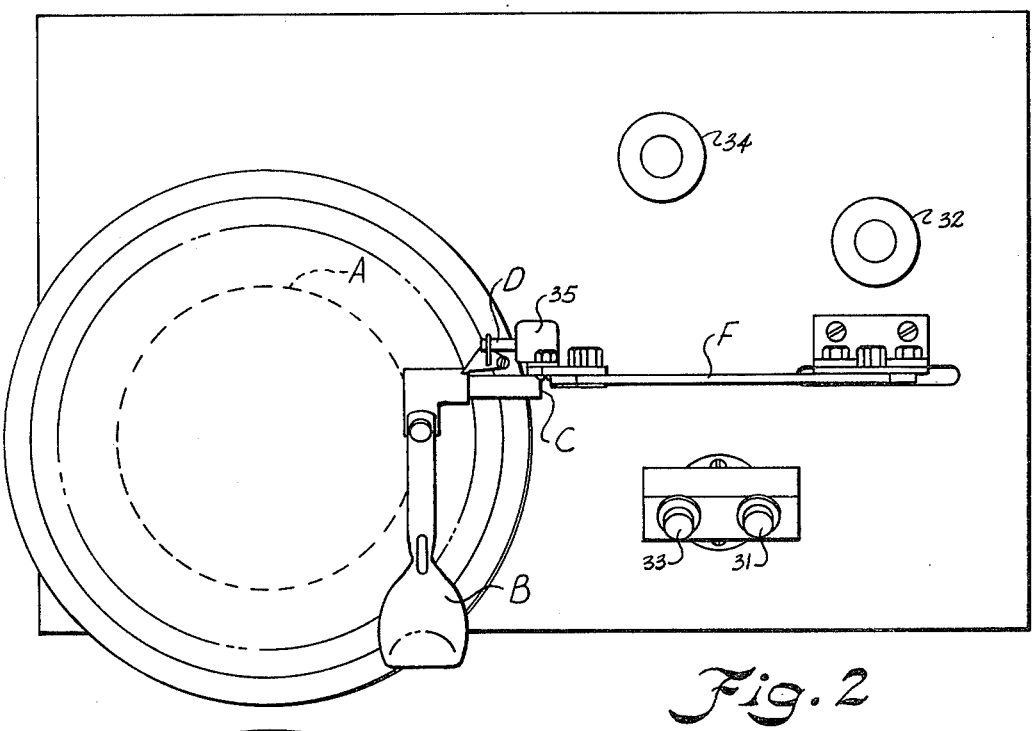
FIG. 2 is a top plan view, at a reduced scale, of the self-feeding apparatus illustrated in FIG. 1.

The link includes a lower end 23 (FIGS. 1 and 2) which is pivotally connected through the connection 21 to a connecting rod 24 having pivotal connection on one end with one end of a walking beam 25. The walking beam 25 also has pivotal connection on its other end with one end of a connecting rod 26. The walking beam is pivoted intermediate its ends as at 27. The connecting rod 26 has connection with and forms a part of a crank **27*a* on the other end which has connection with a disk 32*a* carried by a motor 32 which is mounted upon the support. The disk 32*a* carries a cam 30 on the periphery thereof for sequentially actuating a number of microswitches 37, 38 and 39. The microswitch 38 has been described earlier in connection with the switch element E. The means G which rotates the table includes a motor 34 which carries a shaft 34*a* for driving the sheave 12 for rotating the table A. A standard 28 is carried by the table for positioning the switch 31 which is mechanically operated for commencing the operating sequence, and the override switch 33** in a convenient location for use by the operator.

When the means G rotates the table to cause the spoon to pick up food and the pivotal connection of the spoon is lowered sufficiently, the latch member 15 of the latching means D becomes automatically secured by any suitable means such as the solenoid 35. The linkage means F then raises the spoon from the plate to eating position.

OPERATION

Actuation by the user of the switch 31 will cause overriding of the microswitch 37 starting the motor 32 cuasing the cam 30 to pass the switch 37 and turn the disk 32*a* one revolution until the switch 37 is opened by the cam stopping the motor 32 when the spoon is at the top of its stroke in feeding position. As the disk 32*a* rotates, the cam 30 will depress the microswitch 38 momentarily causing the solenoid 35 to release the spoon which falls or pivots by gravity down into the scooping position. As the spoon moves down, it strikes the plate an an angle that forces the spoon to move forward or radially on the plate picking up a spoonful of food and at the same time latching the spoon in position to rise to feeding position at the top of the spoon carrier stroke.

When the spoon strikes the plate, the cam 30 on the crank disk closes the switch 39 momentarily causing the motor 34 to rotate the plate so that the food is moved into the spoon as the spoon moves forward on the plate. If the patient wants a bite of a different food carried on his plate, he depresses the switch overriding the microswitch 39 causing the motor 34 to rotate the plate until the desired food is in position to be picked up on the next spoon cycle.

The patient may wear a harness (not shown) strapped to his head. The harness may have a pointer projecting forward which he can use to depress the control switches on the feeder, or to strike the keys of a typewriter and other similar operations.

The microswitch 37 is normally closed, but is opened by the cam 30 to stop the motor 32 at the top of the spoon cycle. The microswitch 38 is normally open, but is closed by the cam as it passes closing the solenoid to trip the spoon latching means. The microswitch 39 is normally open, and is closed by the cam 30 as it passes causing the motor 34 to rotate the plate incrementally by a few degrees. The switch 33 overrides the microswitch 39 and rotates the plate continuously while it is depressed. The manually operable switch 31 overrides the microswitch 37 until the cam has passed so as to start the automatic cycle of operation.

It is thus seen that an automatic self-feeding device has been provided wherein the spoon moves across the plate and the plate is turned toward the spoon during such movement of the spoon to facilitate the pushing of the food into the spoon. The plate rotates slightly each time, but such automatic motion is capable of being overridden to rotate the plate separately through its driving motor. During a sequence of operation, the separate motors for the plate and the spoon respectively are synchronized so as to carry out the entire sequence of readying a bite of food automatically. The coordinated movement of the plate and the spoon tends to keep the food carried by the plate moved to the outer edges of the plate wherein it is more accessible for pickup by the spoon.

While a preferred embodiment of the invention has been described using specific terms, such description is for illustrative purposes only, and it is to be understood that changes and variations may be made without departing from the spirit or scope of the following claims.

What is claimed is:

1. Self-feeding apparatus comprising:
a rotating table for carrying a plate holding food;
a spoon;
an arm carrying said spoon;
power operated means maintaining said spoon in raised position in respect to said arm for eating;
switch means operable to release said means permitting the spoon to be lowered into said plate;
linkage means lowering said arm causing said spoon to move forwardly on said plate; and
means rotating said table to cause said spoon to pick up food whereupon said linkage means raises said spoon from said plate to eating position.

2. The structure set forth in claim 1 wherein said linkage means lowers said arm simultaneously with rotating of the table.

3. The structure set forth in claim 1 including switch means actuating said means rotating said table by a predetermined amount, and a switch de-activating said linkage means when the spoon is raised to eating position.

4. The structure set forth in claim 1 wherein said linkage means includes a crank and a spoon positioning link pivoted intermediate its ends driven by said crank to raise and lower said arm carrying said spoon.

5. The structure set forth in claim 1 including a first motor driving a disk having pivoted connection with said crank, and a cam carried by said disk actuating said switch means.

6. The structure set forth in claim 3 including a first overriding switch operated by a user of the apparatus for starting a sequence of lowering and raising the spoon as well as rotating the table.

7. The structure set forth in claim 6 including a second overriding switch operated by the user for rotating the table by an amount determined by the operator.

8. A self-feeding apparatus comprising:
a rotatable table for carrying a plate holding food;
a spoon;
an arm carrying said spoon;
latch means releasing said spoon permitting same to be lowered by gravity into said plate; and
linkage means for progressively lowering said arm after said latch means releases said spoon causing said spoon to move forwardly or outwardly against said plate for placing food on said spoon.

9. The structure set forth in claim 8 including separate motor means rotating said table by a predetermined amount simultaneously with said movement of said spoon.

10. The structure set forth in claim 9 including means operated by a user overriding said means rotating said table by a predetermined amount so that said spoon may be positioned on the plate as dictated by the operator.

11. A self-feeding apparatus comprising:
a rotatable table for carrying food;
a spoon carried above said table for movement up and down between an eating position and a filling position respectively;
a manual override switch;
a series of microswitches;
a motor for raising and lowering said spoon;

a cam driven for rotation by said motor sequentially operating said microswitches after said motor is set in motion responsive to actuation of said override switch for lowering the spoon, rotating the table and then returning the spoon to raised position.

12. The structure set forth in claim 11 wherein said spoon is pivotally carried remotely on one end thereof, and including a latch releasing said spoon to fall pivotally with subsequent progressive lowering of said one end for advancing the spoon to receive food thereon.

13. The structure set forth in claim 12 including a separate motor means rotating said table by a predetermined amount.

14. A method of self-feeding comprising the steps of:

carrying a spoon in a raised position for eating;

permitting the spoon to be lowered by gravity, while holding the spoon about a pivot point remote from one end thereof, into a plate containing food; and lowering said pivot point pushing said one end of said spoon outwardly against said plate for placing food on said spoon.

15. The method set forth in claim 14 including rotating said plate simultaneously with pushing the spoon outwardly.

* * * * *